US006159598A

United States Patent [19]

Ishimura

[11] Patent Number: 6,159,598

[45] Date of Patent: Dec. 12, 2000

[54] CORE/SHEATH TYPE TEMPERATURE-SENSITIVE SHAPE-TRANSFORMABLE COMPOSITE FILAMENTS

[75] Inventor: Naoya Ishimura, Aichi-ken, Japan

[73] Assignee: The Pilot Ink Co., Ltd., Aichi-ken, Japan

[21] Appl. No.: 09/447,240

[22] Filed: Nov. 23, 1999

[30] Foreign Application Priority Data

Dec. 14, 1998 [JP] Japan ..... 10-375408

[51] Int. Cl.[7] ..... D01F 8/00; D01F 8/04

[52] U.S. Cl. ..... 428/370

[58] Field of Search ..... 428/370, 373, 428/374

[56] References Cited

U.S. PATENT DOCUMENTS

| | | | |
|---|---|---|---|
| 3,803,453 | 4/1974 | Hull | 428/373 |
| 4,663,221 | 5/1987 | Makimura et al. | 428/373 |
| 5,153,066 | 10/1992 | Tanaka et al. | 428/373 |

FOREIGN PATENT DOCUMENTS

| | | |
|---|---|---|
| 0 410 415 | 1/1991 | European Pat. Off. . |
| 0 802 237 | 10/1997 | European Pat. Off. . |
| 3 -185102 | 12/1989 | Japan . |
| 3-185103 | 8/1991 | Japan . |

*Primary Examiner*—N. Edwards
*Attorney, Agent, or Firm*—Fitzpatrick, Cella, Harper & Scinto

[57] ABSTRACT

In a core/sheath type temperature-sensitive shape-transformable composite filament comprising a thermoplastic resin (A) and a thermoplastic polymer (B) having a glass transition temperature within the range of from 0° C. to 70° C., the composite filament is constituted in proportions satisfying the following expressions (1), (2) and (3).

In the core;

$$(A)/(B)=5/95 \text{ to } 90/10 \text{ (\% by weight)} \quad (1)$$

In the sheath;

$$(A)/(B)=100/0 \text{ to } 50/50 \text{ (\% by weight)} \quad (2)$$

$$\text{Core/sheath}=10/90 \text{ to } 95/5 \text{ (\% by weight)} \quad (3)$$

The filament is useful as doll hair the hair style of which is thermally shape-transformable to any desired shapes even by infants, and is easily fixable to the transformed shape by cooling.

13 Claims, No Drawings

CORE/SHEATH TYPE TEMPERATURE-SENSITIVE SHAPE-TRANSFORMABLE COMPOSITE FILAMENTS

This application claims the benefit of Japanese Patent Application No. 10-375408 which is hereby incorporated by reference.

BACKGROUND OF THE INVENTION

1. Field of the Invention

This invention relates to a core/sheath type temperature-sensitive shape-transformable composite filament. More particularly, it relates to a core/sheath type temperature-sensitive shape-transformable composite filament useful as an artificial hair for doll hair (the hair of the head of a doll) and wigs or as a thermally shape-transformable fiber material, that is transformable to any desired shapes upon application of an external stress in a temperature region not lower than a temperature about the glass transition temperature of a specific thermoplastic polymer and lower than its melting point, and has the function to become fixed to the transformed shape in a temperature region lower than the glass transition temperature.

2. Related Background Art

Fibers of a vinylidene chloride type, vinyl chloride type, polyamide type or polyolefin type or fibers comprised of an acrylic polymer containing vinyl chloride and vinylidene chloride in a prescribed proportion are conventionally known as fibers for doll hair.

In the case of the doll hair making use of the above fibers, the hair style can not be transformed unless it is done at a high temperature not lower than the melting point of the fibers and also using a special tool. Thus, e.g., infants can not curl the hair to play with at will.

Under such circumstances, it is proposed in Japanese Patent Application Laid-open No. 10-1545 (U.S. Pat. No. 5,895,718) that a specific thermoplastic resin and a thermoplastic polymer having a glass transition temperature within the range of from −20° C. to 70° C. are blended in a specific proportion to obtain various molded products that function to be transformed upon application of an external force under low-temperature and fixed to the transformed shape by cooling.

The molded products proposed therein are applicable as shape-transformable toy shapes of various types and shape-transformable filaments.

SUMMARY OF THE INVENTION

An object of the present invention is to provide a core/sheath type temperature-sensitive shape-transformable composite filament useful as an artificial hair for doll hair and wigs or as a thermally shape-transformable fiber material, satisfying all of functionality, productivity and safe-keeping with time, which filament is transformable to any desired shapes upon application of an external stress in a temperature region of from 0° C. to 70° C., and preferably from 10° C. to 50° C., is fixable to the transformed shape by cooling, can perpetually present the function of shape transformation even when the shape is repeatedly transformed, and also can make filaments free from sticking together (cohering) even when they are left in close contact with one another.

The present invention provides a core/sheath type temperature-sensitive shape-transformable composite filament comprising a thermoplastic resin (A) and a thermoplastic polymer (B) having a glass transition temperature within the range of from 0° C. to 70° C., the composite filament is constituted in proportions satisfying the following expressions (1), (2) and (3), and, upon application of an external stress in a temperature region not lower than a temperature about the glass transition temperature of the thermoplastic polymer (B) and lower than its melting point, is transformable to any shapes that conform to that stress, and is capable of becoming fixed to the transformed shape in a temperature region lower than the glass transition temperature.

In the core;

$$(A)/(B)=5/95 \text{ to } 90/10 \text{ (\% by weight)} \quad (1)$$

In the sheath;

$$(A)/(B)=100/0 \text{ to } 50/50 \text{ (\% by weight)} \quad (2)$$

$$\text{Core/sheath}=10/90 \text{ to } 95/5 \text{ (\% by weight)} \quad (3)$$

Preferably, the components (A) and (B) may constitute the filament in a proportion of (A)/(B)=50/50 to 10/90 (% by weight) in total; that the (A)/(B) in the core=50/50 to 10/90 (% by weight), the (A)/(B) in the sheath=100/0 to 50/50 (% by weight) and the core/sheath=50/50 to 90/10 (% by weight); that the thermoplastic resin (A) and the thermoplastic polymer (B) are selected from polymers having chemical structures different from each other; that the thermoplastic resin (A) is selected from resins having a melting point or softening point of 100° C. or above; that the thermoplastic resin (A) comprises a thermoplastic elastomer; that the thermoplastic elastomer is selected from the group consisting of a polyamide copolymer, a polyurethane copolymer, a polystyrene copolymer, a polyolefin copolymer, a polybutadiene copolymer, a polyester copolymer and an ethylene-vinyl acetate copolymer; that the thermoplastic polymer (B) has a glass transition temperature of from 20° C. to 65° C.; that the thermoplastic polymer (B) is a polymer selected from the group consisting of a saturated polyester resin, an acrylate resin, a methacrylate resin and a vinyl acetate resin; that the filament has an external diameter of from 30 $\mu$m to 3 mm; and/or that the filament is an artificial hair for doll hair or for a wig, having an external diameter of from 30 $\mu$m to 200 $\mu$m.

DESCRIPTION OF THE PREFERRED EMBODIMENTS

The core/sheath type temperature-sensitive shape-transformable composite filament of the present invention is constituted basically of a thermoplastic resin (A) and a thermoplastic polymer (B) having a glass transition temperature within the range of from 0° C. to 70° C.

The thermoplastic resin (A) may include polymers selected from any of polyamide resins such as nylon 6, nylon 6/6, nylon 12, nylon 6/9, nylon 6/12, a nylon 6-6/6 copolymer, a nylon 6-12 copolymer, a nylon 6-6/6-12 copolymer and a nylon 6/9-12 copolymer, polyester resins such as polyethylene terephthalate and polybutylene terephthalate, acrylonitrile-styrene copolymer resins, acrylonitrile-butadiene-styrene copolymer resins, polycarbonate resins, vinylidene chloride-vinyl chloride copolymer resins, copolymer acrylonitrile resins, polyamide type thermoplastic elastomers such as polyamide-polyether block copolymer resins, styrene type thermoplastic elastomers such as styrene-butadiene block copolymer resins, polyolefin type thermoplastic elastomers such as polypropylene-ethylene propylene rubber block copolymer resins, polybutadiene type thermoplastic elastomers, polyester type thermoplastic elastomers, and thermoplastic elastomers such as ethylene-vinyl acetate copolymers.

Of the resins described above, resins generally used for forming fibers and having a melting point or softening point of 100° C. or above are effective because they can maintain a proper rigidity to contribute to form-retention as a base resin.

To maintain the initial flexible softness over a long period of time, it is preferable to use the thermoplastic elastomer. When the thermoplastic elastomer is used, the filament can be prevented from becoming hard with time or with an increase in crystallizability due to stress.

The thermoplastic polymer (B) may include saturated polyester resins, acrylate resins, methacrylate resins, vinyl acetate resins, polyamide resins, epoxy resins (uncured products), hydrocarbon resins, soft vinyl chloride resins, ethylene-vinyl acetate copolymer resins, vinyl chloride-vinyl acetate copolymer resins, vinyl chloride-acrylate copolymer resins, styrene resins, and acrylate-styrene copolymer resins.

Of the thermoplastic polymer (B), polymers having a glass transition temperature of from 0° C. to 70° C., preferably from 5° C. to 65° C., more preferably from 20° C. to 65° C., and still more preferably from 30° C. to 50° C., are effective because they can well balance the shape transformability by external force and the shape retentivity at normal temperature. In particular, saturated polyester resins, acrylic resins, vinyl chloride-vinyl acetate copolymer resins and styrene resins are preferred because they satisfy filament forming properties and the above balanced properties.

Selection of a thermoplastic polymer (B) having a glass transition temperature within the above range makes it possible to obtain doll hair which is transformable to any desired hair style at a temperature within the daily-life temperature range or about that temperature or by the use of any conventionally known various hair style transforming tools or by appropriate stress transforming means and has the function to retain the transformed hair style upon cooling, thus infants or the like can readily change hair style to play with. This hair can also be convenient as wigs for public entertainments, as being readily shape-transformable to various hair styles.

The constitution of the present invention will be detailed below with reference to its operation and effect.

According to the present invention, in a system where the thermoplastic resin (A) and the thermoplastic polymer (B) are present together, at least the thermoplastic polymer (B) in the core is blended in a disperse state or a mixed state of dispersion and mutual melt. This brings out the function of the present invention effectively.

When constituted as described above, the thermoplastic polymer (B) assumes relatively rigid properties in a temperature region lower than its glass transition temperature but changes to have a viscoelasticity at a temperature not lower than the glass transition temperature to cause a decrease in flexural modulus, to bring about a relative decrease in rigidity and flexural modulus of the originally rigid, thermoplastic polymer (B), so that the product becomes transformable to any desired shapes upon application of an external stress and the transformed shape is fixed as a result of restoration of the thermoplastic polymer (B) to the original rigidity in a temperature region lower than its glass transition temperature.

In order to form the above disperse state or mixed state of dispersion and mutual melt, the thermoplastic polymer (B) and the thermoplastic resin (A) are selected from polymers having chemical structures different from each other. If resins having like chemical structures, i.e., resins having like properties are used in combination, a homogeneous mutual melt is formed and the viscoelasticity brought by the thermoplastic polymer (B) at a temperature not lower than its glass transition temperature is exhibited as it is, without any proper control by the thermoplastic resin (A), resulting in an excessive viscosity to affect filament forming properties adversely. Moreover, the filaments formed may stick together (cohere) when they are brought into close contact with one another, to damage practical performance, and also may result in a lowering of the function of shape-fixing in the temperature region lower than the glass transition temperature to make them not function effectively as temperature-sensitive shape-transformable filaments.

According to the present invention, it is essential that, in the composite system of the thermoplastic resin (A) and thermoplastic polymer (B), the following expressions (1), (2) and (3) are satisfied, whereby core/sheath type temperature-sensitive shape-transformable filaments can be provided which satisfy composite fiber forming properties (productivity), shape-transformability adapted to external force under application of a heat, shape-fixability upon cooling and durability and also have the practical function that they are free from sticking together (cohere) when left in close contact.

In the core;

$$(A)/(B)=5/95 \text{ to } 90/10 \text{ (\% by weight)} \quad (1)$$

In the sheath;

$$(A)/(B)=100/0 \text{ to } 50/50 \text{ (\% by weight)} \quad (2)$$

$$\text{Core/sheath}=10/90 \text{ to } 95/5 \text{ (\% by weight)} \quad (3)$$

With an increase in the weight of the thermoplastic polymer (B) in the expressions (1) and (2), the viscosity increases and also the shape-transformability increases.

In the expression (1), if the component (B) is more than 95% by weight, pellets may stick together (cohere) in a molding machine to cause poor discharging and drawing from a filament forming machine, making it difficult to form proper cores. If on the other hand the component (B) is less than 10% by weight, no viscoelasticity may be exhibited at the time of thermal shape-transforming, and the component does not contribute the lowering of flexural modulus, so that the resulting filaments may lack in shape-transformability. The component (B) may preferably be in the range of from 50 to 90% by weight.

In the expression (2), if the component (B) is more than 50% by weight, it forms a tacky sheath surface and hence the filaments may stick together (cohere) when they are left in close contact with one another, to damage practical performance. It is effective for the component (B) in the sheath to be within a range of from 0 to 50% by weight, which depends on its correlation with the component (B) in the core. Here, the function described above can effectively be brought out when the filament meets a requirement that the components (A) and (B) constitutes the filament in a proportion of (A)/(B)=50/50 to 10/90 (% by weight) in total.

The expression (3) relates to the properties of forming core/sheath type composite fibers. A system where the sheath constitutes the filament in a proportion less than 5% by weight lacks in the balance with the core to make it difficult to satisfy fiber forming properties and practical performance. The sheath may constitute the filament in a proportion ranging from 5 to 90% by weight, preferably from 10 to 90% by weight, and more preferably from 10 to 50% by weight, which depends also on the relation with external diameter of the filament formed.

Satisfaction of the expressions (1) to (3) provides a core/sheath type temperature-sensitive shape-transformable composite filament with any desired diameter, having the fiber forming properties (productivity) and the function of practical performance.

In the above combination of the components (A) and (B), the components (A) and (B) may each be not necessarily a single resin or polymer, and may each be used in combination of a plurality of resins or polymers.

The filament of the present invention may have an external diameter ranging from 30 μm to 200 μm in the case of general-purpose doll hair or artificial hair for wigs, and may have an external diameter of from about 1 mm to about 2 mm in the case of toy-purpose special uses.

When used for the artificial hair, it is effective to use a combination system where the thermoplastic resin (A) is a polyamide type thermoplastic elastomer and the thermoplastic polymer (B) is a saturated polyester resin having a glass transition temperature of from 0 to 50° C., in particular, a constitution where the components (A) and (B) are melt-blended in the core and in the sheath. In the foregoing, the polyamide type thermoplastic elastomer has an appropriate moisture absorption, feel and so forth having a rich similarity to the properties of the hair, and has a high strength. Thus, it satisfies the durability when used in combination with the saturated polyester resin.

The filament of the present invention may appropriately be colored as occasion calls. Stated specifically, a colored filament can be formed by blending from 0.05 to 1.0 g of a usual pigment, from 1 to 20 g of a fluorescent pigment and from 10 to 100 g of a thermochromic microcapsule pigment per 1 kg of the thermoplastic resin (A) or thermoplastic polymer (B) used to form the filament, followed by spinning.

Conventional general-purpose light stabilizers, e.g., light stabilizers selected from ultraviolet light absorbers, antioxidants, anti-aging agents, singlet oxygen quenchers, ozone quenchers, visible light absorbers and infrared light absorbers may further be appropriately mixed. A light-stabilizer layer in which the light stabilizer is incorporated in a binding agent may also be provided on the surface.

Any of conventional general-purpose various plasticizers of, e.g., a phthalic acid type, an aliphatic dibasic acid ester type, a phosphate type, an epoxy type, a phenol type and a trimellitic acid type may be mixed in an amount of from 1 to 30% by weight so that the shape-transformable temperature can be made lower or a flexibility can be imparted.

Calcium carbonate, magnesium carbonate, titanium oxide, talc or other color pigment may further be added in order to improve workability and physical properties.

With regard to the addition of the pigments and so forth, they may be added not only to the core but also to both the core and the sheath, or only to the sheath. Especially when the pigments and fillers are mixed in the sheath, a low transparency or surface gloss may result, but the filaments formed can be prevented from sticking together when they are left in close contact and also the rubbery feel inherent in elastomers can be avoided.

As the thermochromic microcapsule pigment mentioned above, it is effective to use a pigment of known form in which a thermochromic material containing three components, an electron-donating color forming organic compound, an electron-accepting compound and an organic compound medium capable of reversibly causing color-forming reaction is enclosed in microcapsules. As examples of the thermochromic material, it may include thermochromic materials disclosed in Japanese Patent Publications No. 51-44706, No. 51-44708 and No. 1-29398 (U.S. Pat. No. 4,732,810) and Japanese Patent Application Laid-open No. 7-186540 (U.S. Pat. No. 5,558,700). The thermochromic material causes metachromatism at around a given temperature (metachromatic point) and, in a normal temperature region, can only exist in the specific one condition of both the condition before change and the condition after change.

More specifically, the thermochromic material has a thermochromic performance of the type that causes metachromatism while showing a small hysteresis width (ΔH) in relation to what is called the temperature-color density relying on temperature changes, which is the performance that the other condition is maintained so long as the heat or coldness necessary for that condition to appear is applied but, once the heat or coldness becomes no longer applied, returns to the condition to be assumed in the normal temperature region.

It is also effective to use the material disclosed in Japanese Patent Publication No. 4-17154 (U.S. Pat. No. 4,720,301), No. 7-179777 (U.S. Pat. No. 5,558,699) or No. 7-33997 (U.S. Pat. No. 5,879,443), which is a thermochromic material that causes metachromatism showing great hysteresis characteristics, i.e., a metachromatic material that causes metachromatism along such a course that the shape of a curve formed by plotting changes in coloring density caused by changes in temperature is greatly different between an instance where the temperature is raised from a lower-temperature side than a metachromatic temperature region and an instance where the temperature is raised inversely from a higher-temperature side than the metachromatic temperature, and has a characteristic feature that the condition of a change made at a temperature not higher than the low-temperature-side metachromatic point or not lower than the high-temperature-side metachromatic point in a normal temperature region between the low-temperature-side metachromatic point and the high-temperature-side metachromatic point can be retained as memory.

The thermochromic material described above can be effective even when used as it is, or may be used by enclosing it in microcapsules because the thermochromic material can be kept to have the same composition under various use conditions and can have the same operation and effect.

In the latter instance, the microcapsules used may have a particle diameter ranging from 1 to 30 μm, and preferably from 5 to 15 μm.

The core/sheath type temperature-sensitive shape-transformable composite filament of the present invention is obtained in the form of multi-filaments or in the form of mono-filaments, and is used chiefly for fibers for doll hair or artificial hair for wigs. It may also be made into short fibers or be subjected to curling or frizzling so as to be used as a shape-transformable fiber material.

EXAMPLES

The present invention will be described below in greater detail by giving Examples. The present invention is by no means limited by these Examples. In the following Examples, formulation is indicated as "part(s) by weight".

Example 1

A mixture of 150 parts of a polyamide type thermoplastic elastomer (trade name: DIAMID E62; available from Daicel-Hüls Ltd.; meltingpoint: 170° C.) as the thermoplastic resin (A) and 850 parts of polyester resin (trade name: ELITEL UE-3250; available from Unichika, Ltd.; glass transition temperature: 40° C.) as the thermoplastic polymer (B) was used for the core, and a mixture of 700 parts of the above thermoplastic resin (A) and 300 parts of the above thermoplastic polymer (B) was used for the sheath. Using a composite fiber spinning machine, the mixtures were spinned at 190° C. out of a die having 24 discharge orifices, in such a way that the filament was constituted in a proportion of core/sheath=8/2 (weight ratio), followed by drawing to obtain multi-filaments of core/sheath structure, comprised of 24 composite filaments of about 80 μm diameter each.

The multi-filaments were set in the head of a doll by a conventional means, and this head was joined to the body to make up a toy doll.

The above hair of the toy doll was wound on a cylindrical hair curler of 9 mm in diameter and kept in a 42° C. oven, or wound on a hair curler heated to 42°C., and this was heated for 3 minutes. Subsequently, the hair thus processed was left at a room temperature of 25° C., and thereafter the curler was removed, whereupon the hair came to stand curled in the same inner diameter as the outer diameter of the curler. This condition was retained as long as any external force was applied.

Next, the hair standing curled was stretched straight and fixed to that shape by means of a fixing tool. This hair was again heated in the 42° C. oven or fixed to the fixing tool, heated to 42° C., and thereafter left at room temperature. Then the fixing tool was removed, whereupon the hair returned to the initial condition where it stood straight.

Even without use of the fixing tool, the curled hair, after heated in the 42° C. oven, returned to the condition where it stood straight, by brushing it immediately thereafter while stretching the hair with a comb or brush.

The above shape-transformation takes place upon application of an external force at about 42° C. or above, and the condition where the shape-transformation has taken place is fixed at about 30° C. or below. The thermal shape-transformation caused by applying an external force and the function to retain this condition upon cooling can repeatedly be reproduced, and also can be done in any other shapes as desired.

Example 2

A mixture of 400 parts of a copolymer polyamide resin (trade name: DIAMID N1901; available from Daicel-Hüls Ltd.; melting point: 155° C.) as the thermoplastic resin (A) and 600 parts of polyester resin (trade name: POLYESTER TP-217; available from The Nippon Synthetic chemical Industries Co, Ltd.; glass transition temperature: 40° C.) as the thermoplastic polymer (B) was used for the core, and a mixture of 700 parts of the above thermoplastic resin (A), 300 parts of the above thermoplastic polymer (B) and 1 part of a blond color pigment was used for the sheath. Using a composite fiber spinning machine, the mixtures were spinned at 190° C. out of a die having 24 discharge orifices, in such a way that the filament was constituted in a proportion of core/sheath=8/2 (weight ratio), followed by drawing to obtain multi-filaments of core/sheath structure, comprised of 24 composite filaments of about 80 μm diameter each.

Using the multi-filaments obtained, a toy doll was made up in the same manner as in Example 1, and was likewise tested using a cylindrical hair curler of 9 mm in diameter. As a result, the shape was transformed at a temperature of 42° C., and the condition where it stood transformed was fixed at a room temperature of 25° C. or below.

Example 3

A mixture of 400 parts of polybutylene terephthalate modified with 35 mole % of isophthalic acid (melting point: 168° C.) as the thermoplastic resin (A) and 600 parts of acrylic resin (trade name: DIANAL BR-177; available from Mitsubishi Rayon Co, Ltd.; glass transition temperature: 35° C.) as the thermoplastic polymer (B) was used for the core, and a mixture of 700 parts of the above thermoplastic resin (A) and 300 parts of the above thermoplastic polymer (B) was used for the sheath. Using a composite fiber spinning machine, the mixtures were spinned at about 190° C. out of a die having 24 discharge orifices, in such a way that the filament was constituted in a proportion of core/sheath=8/2 (weight ratio), followed by drawing to obtain multi-filaments of core/sheath structure, comprised of 24 composite filaments of about 80 μm diameter each.

Using the multi-filaments obtained, a toy doll was made up in the same manner as in Example 1, and was likewise tested using a cylindrical hair curler of 9 mm in diameter. As a result, the shape was transformed at a temperature of 38° C., and the condition where it stood transformed was fixed at a room temperature of 20° C. or below.

Example 4

Preparation of reversibly thermochromic microcapsular pigment composition:

A reversibly thermochromic material comprised of 2 parts of 1,2-benzo-6-diethylaminofluorane, 6 parts of 1,1-bis(4-hydroxyphenyl)-n-octane and 50 parts of stearyl caprate was made into microcapsules by epoxy resin/amine interfacial polymerization to obtain a reversibly thermochromic microcapsular pigment composition having an average particle diameter of 10 to 20 μm.

The pigment composition obtained was reversibly changeable to turn colorless at about 34° C. or above and turn pink at about 28° C. or below.

30 parts of a material obtained by drying and dehydrating the microcapsule pigment composition and 1,000 parts of the core material obtained in Example 1 were mixed, and the mixture obtained was spinned at 190° C. in a proportion of core/sheath=8/2 (weight ratio), followed by drawing to obtain temperature-sensitive thermochromic shape-transformable multi-filaments comprised of 24 filaments of about 80 μm external diameter each, which were used as doll hair.

The above pink hair was held between corrugated plates having hill-to-hill periods of 1 cm and fixed there. This was put into a 42° C. oven, whereupon the hair turned from pink to colorless. After heated for 3 minutes, the hair was left at a room temperature of 25° C., whereupon it again colored in pink. The corrugated plates were removed, where the hair stood wavy in the same periods of the corrugated plates, and retained this condition as long as any external force was applied.

Next, the hair standing wavy was stretched straight and fixed to that shape by means of a fixing tool, and then again heated in the 42° C. oven, whereupon it turned colorless. Where it was left at a room temperature, it colored in pink, and, when the fixing tool was removed, it returned to the initial condition where it stood straight.

In the above shape-transformation/fixation, the shape-transformation at about 42° C. or above and shape-fixation at about 30° C. or below were repeatable. This change took place while making a border substantially around the glass transition temperature of the polyester resin used. The shape-transformation was likewise achievable by using a heated hair curler.

Example 5

A mixture of 200 parts of a polyamide type thermoplastic elastomer (trade name: PEBAX 6333; available from Toray Industries, Inc.; melting point: 172° C.) as the thermoplastic resin (A) and 800 parts of a thermoplastic polymer (B) (trade name: VYLON 103; available from Toyobo Co., Ltd.; glass transition temperature: 47° C.) was used for the core, and a nylon resin (trade name: RILSAN AMNO; available from Toray Industries, Inc.; melting point: 180° C.) was used for the sheath. Using a composite fiber spinning machine, the mixtures were spinned at 200° C. out of a die having 24 discharge orifices, in such a way that the filament was constituted in a proportion of core/sheath=8/2 (weight ratio), followed by drawing to obtain multi-filaments of core/sheath structure, comprised of 24 composite filaments of about 80 μm diameter each.

Using the multi-filaments obtained, a toy doll was made up in the same manner as in Example 1, and was likewise tested using a cylindrical hair curler of 9 mm in diameter. As a result, the shape was transformed at a temperature of 50° C., and the condition where it stood transformed was fixed by leaving the hair at a room temperature of 30° C. or below after transformation.

Example 6

Using the multi-filaments obtained in Example 1, a cloth of plain fabrics was prepared, and was wound on a cylinder of 30 mm diameter, made of paper, which was then heated for 3 minutes in a 42° C. oven and subsequently left at a room temperature of 25° C. Thereafter the paper cylinder was removed, where the cloth came to stand rolled up in the same diameter of the paper cylinder and retained that shape as long as no external force was applied.

Next, this cloth was stretched planely and fixed to that shape by means of a fixing tool, and was again heated in a 42° C. oven. Thereafter, this was left at a room temperature and then the fixing tool was removed, whereupon the cloth returned to the initial plane shape.

The doll hairs described above in Examples 1 to can be substituted for artificial hairs for wigs as they are.

The temperature-sensitive shape-transformable composite filament is constructed in core/sheath structure, and the proportions of the thermoplastic resin (A) and thermoplasticpolymer (B) with a specific glass transition temperature in the core and the sheath and also the proportion of core/sheath are specified. Thus, the productivity (filament forming properties) can be satisfied as a matter of course, and the filament has shape-transformability and shape-fixability in the daily-life temperature range and can be free from sticking together (cohering) even when filaments are left in close contact with one another, satisfying both the readiness to handle and the practical performance.

When the filament of the present invention is used as doll hair or an artificial hair for wigs, or as an artificial hair for stuffed toys, it can be transformed to any desired shapes with ease in a temperature region of from 0° C. to 70° C. (preferably a temperature region of from 10° C. to 50° C.), the shape standing transformed can be retained in a low-temperature region, and also it has a permanence that the shape thus retained can be returned to the original condition or can repeatedly be transformed in different ways, satisfying the practical performance as simple shape-transformable artificial hair. It is also applicable to yarn, woven fabric and so forth as simple shape-transformable fiber materials.

What is claimed is:

1. A core/sheath temperature-sensitive shape-transformable composite filament comprising a thermoplastic resin (A) and a thermoplastic polymer (B) having a glass transition temperature within the range of from 0°C. to 70°C.;

said composite filament being constituted in proportions satisfying the following expressions (1), (2) and (3), and, upon application of an external stress in a temperature region not lower than a temperature about the glass transition temperature of the thermoplastic polymer (B) and lower than its melting point, being transformable to any shapes that conform to that stress, and being capable of becoming fixed to the transformed shape in a temperature region lower than the glass transition temperature In the core;

$$(A)/(B)=5/95 \text{ to } 90/10 \text{ (\% by weight)} \quad (1)$$

In the sheath;

$$(A)/(B)=100/0 \text{ to } 50/50 \text{ (\% by weight)} \quad (2)$$

$$\text{Core/sheath}=10/90 \text{ to } 95/5 \text{ (\% by weight)} \quad (3).$$

2. The core/sheath temperature-sensitive shape-transformable composite filament according to claim 1, wherein said components (A) and (B) constitute the filament in a proportion of (A)/(B)=50/50 to 10/90 (% by weight) in total.

3. The core/sheath temperature-sensitive shape-transformable composite filament according to claim 1, wherein the (A)/(B) in the core=50/50 to 10/90 (% by weight), the (A)/(B) in the sheath=100/0 to 50/50 (% by weight) and the core/sheath=50/50 to 90/10 (% by weight).

4. The core/sheath temperature-sensitive shape-transformable composite filament according to claim 1, wherein said thermoplastic resin (A) and said thermoplastic polymer (B) are selected from polymers having chemical structures different from each other.

5. The core/sheath temperature-sensitive shape-transformable composite filament according to claim 1, wherein said thermoplastic resin (A) is selected from resins having a melting point or softening point of 100° C. or above.

6. The core/sheath temperature-sensitive shape-transformable composite filament according to claim 1, wherein said thermoplastic resin (A) comprises a thermoplastic elastomer.

7. The core/sheath temperature-sensitive shape-transformable composite filament according to claim 6, wherein said thermoplastic elastomer is selected from the group consisting of a polyamide copolymer, a polyurethane copolymer, a polystyrene copolymer, a polyolefin copolymer, a polybutadiene copolymer, a polyester copolymer and an ethylene-vinyl acetate copolymer.

8. The core/sheath temperature-sensitive shape-transformable composite filament according to claim 1, wherein said thermoplastic polymer (B) has a glass transition temperature of from 20° C. to 65° C.

9. The core/sheath temperature-sensitive shape-transformable composite filament according to claim 1, wherein said thermoplastic polymer (B) is a polymer selected from the group consisting of a saturated polyester resin, an acrylate resin, a methacrylate resin and a vinyl acetate resin.

10. The core/sheath temperature-sensitive shape-transformable composite filament according to claim 1, which has an external diameter of from 30 $\mu$m to 3 mm.

11. The core/sheath temperature-sensitive shape-transformable composite filament according to claim 1, which is an artificial hair having an external diameter of from 30 $\mu$m to 200 $\mu$m.

12. The core/sheath temperature-sensitive shape-transformable composite filament according to claim 1, which is an artificial hair for doll hair or for a wig.

13. The core/sheath temperature-sensitive shape-transformable composite filament according to claim 1, wherein a non-thermochromic material, a fluorescent pigment or a thermochromic microcapsule pigment is blended in said thermoplastic resin (A) or thermoplastic polymer (B).

* * * * *

UNITED STATES PATENT AND TRADEMARK OFFICE

CERTIFICATE OF CORRECTION

PATENT NO. : 6,159,598
DATED : December 12, 2000
INVENTOR(S) : Naoya Ishimura

It is certified that error appears in the above-identified patent and that said Letters Patent is hereby corrected as shown below:

Title page,
Item [56] References Cited - FOREIGN PATENT DOCUMENTS
"3-18502 12/1989 Japan." should read -- 3-185102 8/1991 Japan. --.

Column 4,
Line 46, "contribute" should read -- contribute to --; and
Line 59, "constitutes" should read -- constitute --.

Column 9,
Line 38, "planely" should read -- flat --;
Line 43, "to" should read -- to 5 --.

Column 10,
Line 19, "temperature" should read -- temperature: --;
Line 21, "In" should read -- in -- and "core;" should read -- core --; and
Line 25, "In" should read -- in -- and "sheath;" should read -- sheath --.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*